US005295439A

United States Patent [19]

Carbone

[11] Patent Number: 5,295,439

[45] Date of Patent: Mar. 22, 1994

[54] INCAPACITATING NON-LETHAL MULTIPLE PROJECTILE BALLISTIC ROUND

[75] Inventor: Alfred Carbone, Boscawen, N.H.

[73] Assignee: Academy of Applied Science, Concord, N.H. ; a part interest

[21] Appl. No.: 909,785

[22] Filed: Jul. 7, 1992

[51] Int. Cl.[5] ..... F42B 5/03

[52] U.S. Cl. ..... 102/438; 102/439; 102/444; 102/502; 102/514; 102/529

[58] Field of Search ..... 102/430, 438, 439, 444, 102/447, 448, 460, 501, 502, 506, 514–516, 529

[56] References Cited

U.S. PATENT DOCUMENTS

| | | | |
|---|---|---|---|
| 703,840 | 7/1902 | Scott | 102/438 |
| 1,376,530 | 5/1921 | Greener | 102/438 |
| 4,805,536 | 2/1989 | Kosteck | 102/514 |
| 4,864,934 | 9/1989 | Theising | 102/448 |

FOREIGN PATENT DOCUMENTS

| | | | |
|---|---|---|---|
| 124669 | 10/1901 | Fed. Rep. of Germany | 102/514 |
| 2303263 | 10/1976 | France | 102/438 |
| 24402 | of 1907 | United Kingdom | 102/514 |

OTHER PUBLICATIONS

*Military Explosives* Dept of The Army TM 9-1910, Apr. 1955 pp. 255–259.

*Primary Examiner*—Harold J. Tudor
*Attorney, Agent, or Firm*—Rines & Rines

[57] ABSTRACT

A novel multi-slug bullet or round is provided that, through the use of flat-faced abutting end walls of successive cylindrical slugs, tightly packed above the powder charge in the cartridge casing, and appropriate fast-burning powder charge tailored to the weight of the multiple slugs, achieves multiple-hit stopping power within self-defense ranges and the like with greatly reduced penetration and thus minimal chance of lethality or collateral damage. With a single firing, multiple hits over a controlled area are achieved, materially lessening the requirement for precise aiming, reducing the amount of ammunition and the number of firings required in use, and reducing recoil, while eliminating ricochet effects.

10 Claims, 5 Drawing Sheets

(A) (B)

INCAPACITATING NON-LETHAL MULTIPLE PROJECTILE BALLISTIC ROUND

The present invention relates to powder-discharge-driven ballistic rounds, more particularly, though not exclusively, in bullet or cartridge form, being more specifically concerned with ammunition designed to provide incapacitating non-lethal stopping power.

BACKGROUND

The art is replete with many types of ammunition designed for a wide variety of uses and effects, ranging in the case of hand-held guns, from hard lead pointed penetration projectiles to multiple bursting projectiles such as shot gun pellets on the one hand, and so-called "Glaser" rounds for penetration and the tearing of lethal holes in the recipient, on the other hand. In all such devices, the approach is to employ a rather slow-burning powder to create the required gas expulsion pressure in the cartridge or shell casing to generate muzzle velocity necessary to launch and carry the hard lead projectile(s), packed in the cartridge, to the target for the intended penetration and, most often, lethal effects.

Emphasis in both police and military applications has been also upon developing aiming expertise, with the particular end in view of hitting a precise spot behind which lies an organ or other body part that the bullet is to enter or where the projectile(s) should burst in order to kill the assailant. Multiple firings of successive rounds is provided for in revolvers and semi-automatic and automatic weaponry to insure the ultimate result if the first projectile fails to achieve its goal. Such conditions are described, for example, in an article entitled "Accurately Predicting Stopping Power" appearing in Guns Magazine, 1992.

There are occasions and circumstances, however, including personal or home self-defense, as well as police, military and other uses, where society generally deems it preferable to achieve the stopping or disabling of an attacker or other threatening individual, without inflicting a likely lethal result, and otherwise with low inflicted collateral damage, and most desirably with greatly reduced ricochet potential.

It is to such applications that the present invention is in large measure primarily directed, having also the concomitant synergistic effects of reducing both the required aiming skills and the number of bullets that must be carried in the weapon and potentially fired.

OBJECTS OF INVENTION

An object of the present invention, accordingly, is to provide a new and improved incapacitating and generally non-lethal ballistic round and method of limiting striking collateral damage effects thereof.

A further object is to provide a novel bullet embodying multiple projectiles designed in consort with the expelling powder-generated gases to insure the limitation of the degree of penetration of the projectiles upon striking the recipient or other target, and to provide multiple striking points over a limited controlled region or lateral space distribution or area—such multiple entries also eliminating the necessity for both precise aiming skills and for multiple firings otherwise required in conventional singly fired projectile operation.

Other and further objects will be explained hereinafter and are more particularly delineated in the appended claims.

SUMMARY

In summary, however, from one of its viewpoints, the invention embraces an incapacitating, generally non-lethal multiple projectile powder-driven ammunition round having, in combination, a cylindrical casing containing a powder charge disposed behind a plurality of successive abutting substantially virgin lead slugs of similar solid longitudinally cylindrical shape closely fitting within the casing, and each having flat planar surfaces at the opposing transverse ends of the cylindrical slug, the outermost slug extending beyond the open end of the casing to which it is crimped to expose its flat planar outer surface.

Preferred and best mode designs and constructions and techniques of operation are later described.

DRAWINGS

The invention will now be described in connection with the accompanying drawings, FIG. 1 of which is a cut-away side view of a bullet constructed in accordance with the present invention;

Figure 1:
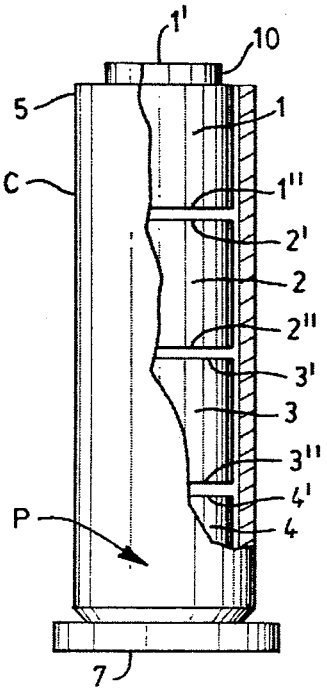

Referring to the drawings, a multiple projectile round, illustrated as of the 0.357 four-slug type ("quadraplex") of FIGS. 1 and 4(A), is constructed, in accordance with the invention, as comprising four successive abutting similar soft, but solid, virgin lead cylindrical slug projectiles 1, 2, 3 and 4, tightly fitting within a conventional bullet casing C of just slightly greater diameter. The outermost slug 1 is crimped at the open edge of the casing C at 5 in conventional fashion, and a special powder charge, later described, is packed in the casing behind the fourth slug 4 at P, at the striking end 7 of the cartridge. Each of the slugs is of substantially the same diameter (related to the caliber) and of substantially the same longitudinal length, and is terminated in parallel flat, planar transverse end surfaces. The inner end surface 1″ of the outermost cylindrical slug 1 is shown in FIG. 1 abutting the adjacent flat parallel end 2′ of the next successive slug cylinder 2. The opposite or opposing flat face 2″ of the slug 2 abuts the corresponding parallel flat end face 3′ of the slug 3;

and the opposite flat end surface 3'' abuts the adjacent flat end 4' of the fourth slug 4.

The outermost slug 1 extends beyond the open casing mouth in a slightly reduced diameter cylindrical section 10, terminating in its flat end surface 1' Preferably, but not always essentially, the outermost slug 1, or its forwardmost portions 10, may be covered with a copper cladding. The front end surface 1' may be unclad or covered by clad, as desired.

Figure 6A:
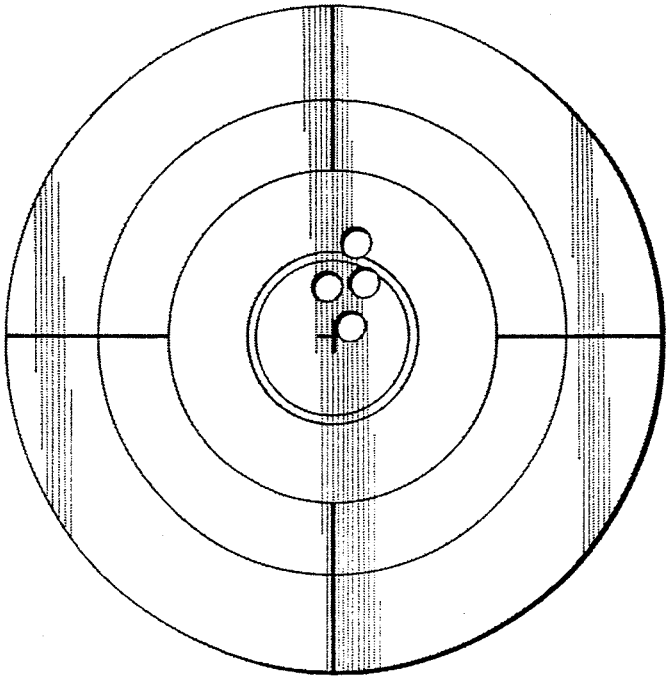
FIG. 6A is a copy of an actual target showing the multiple hit area and distribution at a range of eight feet by the four-slug 0.357 round shown at (A) in FIG. 4.
Figure 6B:
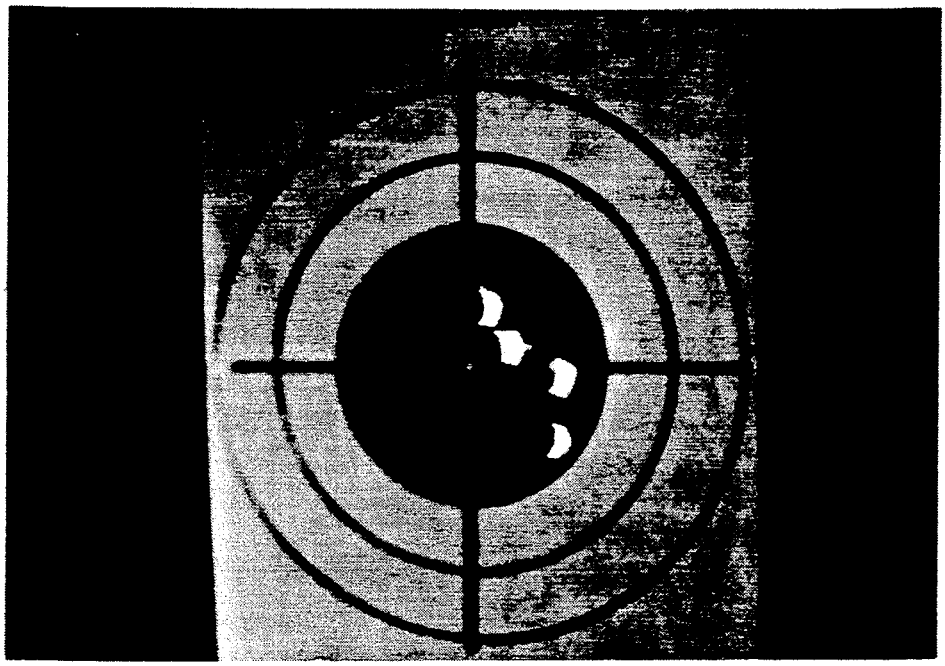
FIG. 6B is a corresponding stroboscopic picture of the four slugs in flight.
Figure 8:
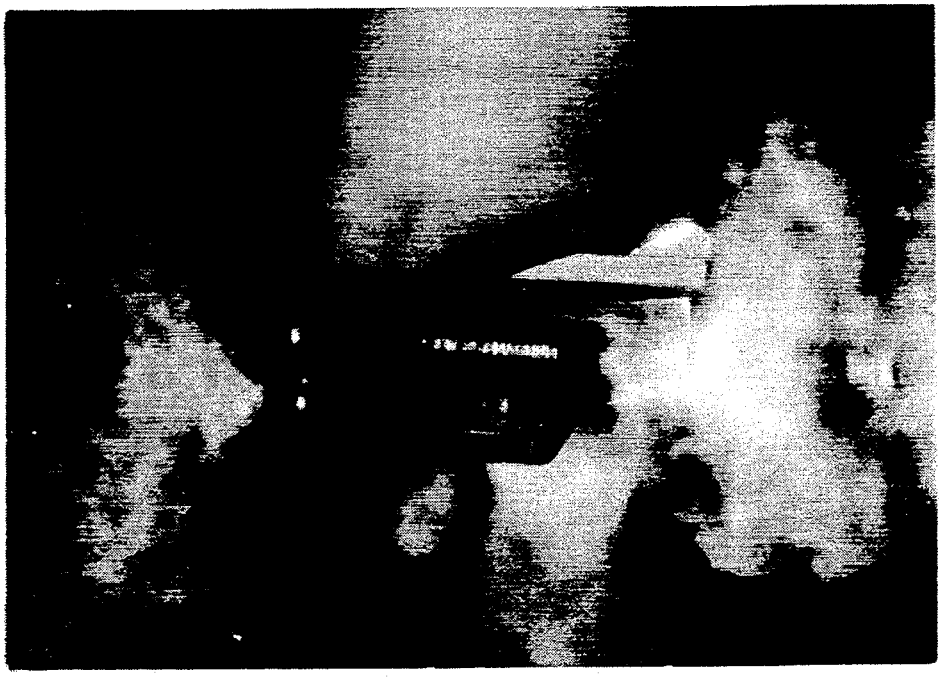
FIG. 8 is a photograph showing the multiple slug launching from the revolver nozzle.

When such a bullet is fired, assuming rather critical weight (density) and powder charge pressures later discussed, the slugs leave the gun muzzle in close succession, as shown in FIG. 8, where the front and next slugs can be seen exiting substantially as a unit. With the described cylindrical flat-end shapes, it has been discovered that the multiple slugs offer appropriate resistance in flight deliberately to dissipate slug energy and cause the slugs to separate or spread out in a very controlled and limited manner or pattern over the relatively close ranges of concern in the above-described self-defense home, store or office and many police and related usages. For the 0.357 four-slug bullet of FIGS. 1 and 4(A), the controlled pattern at 8 feet is shown in the target of FIG. 6A—in this case providing multiple hits over about a two-square inch area. The close and limited-spread slugs are shown in flight preparatory to striking the target in the stroboscopic picture of FIG. 6B.

Thus, an assailant at, for example, eight feet, will be struck at multiple (four) points practically simultaneously and stopped. With suitable critical weight (density), shape and ejection velocities of the invention, it has been discovered that at the time the slugs hit the assailant (within such ranges of self-defense and related interests), their energy is very rapidly spent, minimizing the penetration depth and materially lessening the chance of reaching deeper parts of the body that could cause lethal effects.

Tests in a gelatin target show such most rapid energy dissipation; and when, indeed, the slugs hit a wall, they just drop to the ground or floor.

The importance of the use of the flat end slugs of relatively soft virgin lead (99.99% pure) in the critical cartridge system of the invention is to be stressed; the energy loss and minimal penetration effects not otherwise being found to be obtainable with conventional bullet shapes and of hard (Sb-Sn)Pb alloy.

Figure 4:
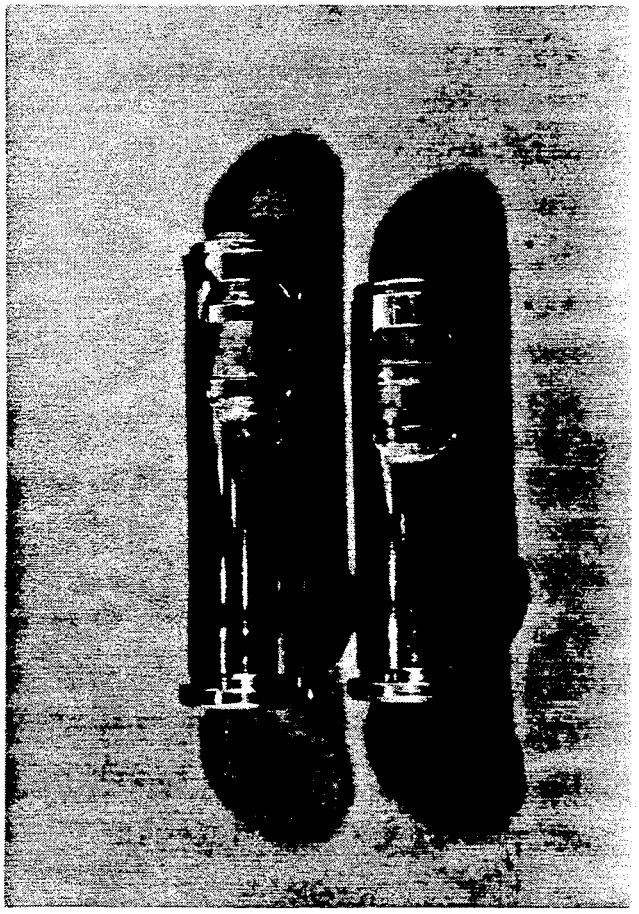
FIG. 4 is a copy of a photograph of actual 0.357 four-projectile ("quadraplex")—(A)—and 0.38 sp three-projectile ("triplex")—(B)—ammunition manufactured in accordance with the invention, with the casing partly cut away to show the projectile construction and packing.
Figure 5A:
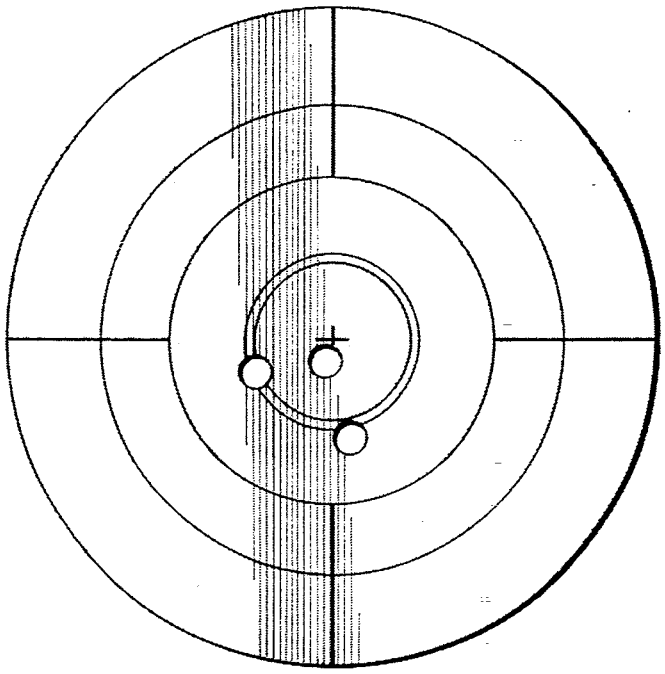
FIG. 5A is a copy of an actual target showing multiple hit spread or distribution at a range of ten feet by the three-slug 0.38 sp round of the type shown at (B) in FIG. 4.
Figure 5B:
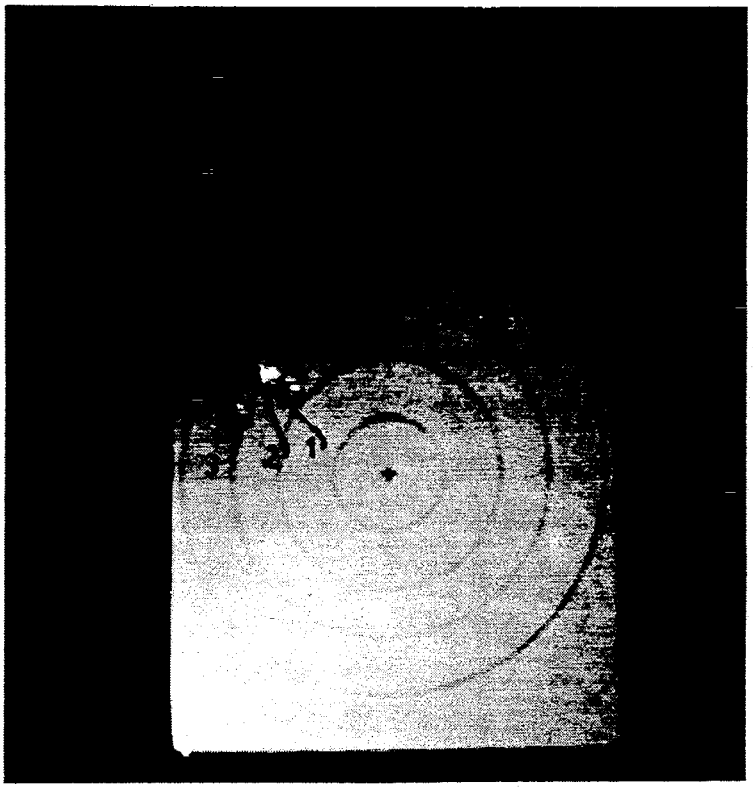
FIG. 5B is a stroboscopic picture of the three simultaneously fired slugs in flight.
Figure 7A:
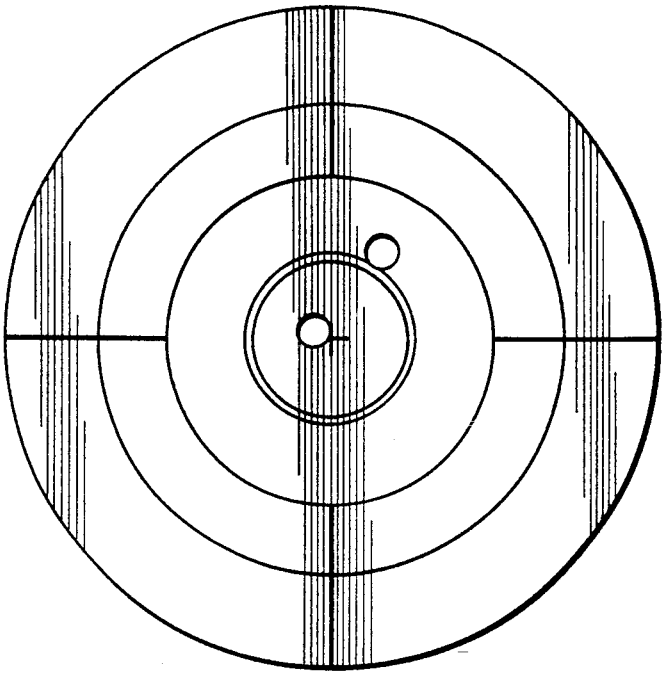
FIGS. 7A and 7B show respective target hits by two-slug 0.45 and 9 mm rounds also embodying the invention, at ten feet.

Similar results for the 0.38 sp three-slug ("triplex") cartridge of FIG. 4 striking at ten feet, are shown in the graph of FIG. 5A, and the in-flight stroboscopic picture of FIG. 5B. Controlled two-hit patterns over somewhat larger areas for two-slug ("duplex") 9 mm and 0.45 caliber bullets at ten feet are shown in the graphs of respective FIGS. 7A and 7B.

Figure 2:
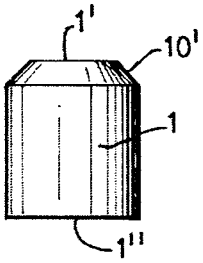
FIGS. 2 and 3 are views similar to FIG. 1 (with FIG. 2 fragmentary only) of modifications for different caliber rounds.
Figure 3:
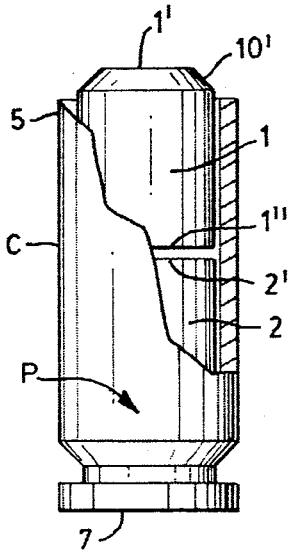
Figure 7B:
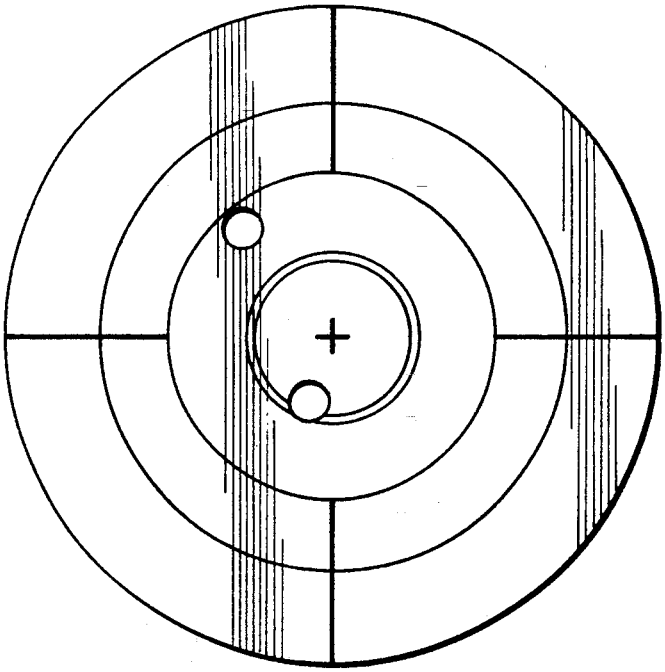

In connection with the two-slug 0.45 performance of FIG. 7B, the construction of such a round is shown in FIG. 3, with the slug 1 fowardly tapered to reduced diameter in frusto-conical shape at 10', but again terminally providing the flat forwardmost face 1'. Once more, copper cladding may be employed at 10'. The taper, moreover, need not be so extensive, as is shown in the modification of FIG. 2.

Turning now to experimentally derived parameters for achieving the novel results of the invention, the following constructions have been successfully employed:

| Caliber | Number of Aubtting Flat-Faced Slugs (virgin Pb) | Weight of Each Slug | Approx. Slug Length | Powder Charge Sufficient to Achieve Muzzle Velocity of |
|---|---|---|---|---|
| .45 ACP | 2 | 125 grains* | .50 inch | 800 f.p.s. |
| .357 | 4 | 56.5 grains | .25 inch | 900 f.p.s. |
| .38 sp | 3 | 56.5 grains | .25 inch | 800 f.p.s. |
| 9 mm | 2 | 56.5 grains | .25 inch | 700 f.p.s. |

*7000 grains/pound

Generally, with the above constructions, there is less space provided in the bullet casing for the powder than in conventional bullets; and the demands for achieving the novel results of the invention have been found to require a considerably faster burning powder (by a factor of two or more) than in conventional bullets. A successful powder propellant for the above purposes has involved spherical double-based smokeless powder in a mix of nitroglycerin and nitrocellulose with the following specifications:

| | |
|---|---|
| Average diameter | .0255 |
| web | .0090 |
| gav metric density (gm/cc) | 0.635 |
| heat of explosion (cal/gm) | 1420 |
| flame temperature (°K.) | 3524 |
| moles of gas/gm. | .0387 |
| ratio of specific heat (Cp/Cr) | 1.22 |

The ammunition of the invention, thus, is especially tailored for self defense, providing creditable knock-down and stopping or incapacitating power, but with minimum penetration, and thus reduced collateral and generally non-lethal damage. The particular type of multiple slug projectiles of the invention, moreover, develops a fast hydrostatic shock by making multiple wounds over a controlled region without over-penetration, such as to incapacitate, rather than destroy, an attacker.

As a result of the novel density, shape and velocity combination underlying the invention, the multiple initially in-line slug discharge is designed, as before explained, to cause rapid loss of speed and ultimately harmless dropping to the ground over a relatively short distance beyond the desired typical indoor or outdoor confrontational ranges over which accuracy is excellent; or, if a target is intercepted, rapid spending of energy on impact of the soft virgin lead slugs, with the weight of the slugs causing them to shed their energy quickly after impact, tending to limit or lessen the likelihood of substantial penetration, including of normal interior walls. Ricochet is therefore substantially eliminated and minimum firing recoil occurs—providing further safety features for street use and for self-defense purposes, particularly. To this is added the benefit of having two, three or four impacts upon the assailant each time the gun trigger is pulled. This, as previously pointed out, not only reduces the necessity for precise aiming, but minimizes the amount of ammunition and separate firings required to stop an assailant.

While the technique, approach and discoveries underlying the invention have been described with reference to hand guns and semi-automatic and automatic rounds, such are believed to be more generally applicable to other types of munitions, as well, wherever the features attainable with the invention may be desired.

To obtain special effects, moreover, some of the slugs may be somewhat varied in length or weight, though substantially similar slugs have been found to be required for the described performance; and further modifications will also occur to those skilled in this art, such being therefore considered to fall within the spirit and scope of the invention as defined in the appended claims.

What is claimed is:

1. An incapacitating, generally non-lethal multiple projectile powder-driven ammunition round having, in combination, a cylindrical casing containing a powder charge disposed behind a plurality of successive abutting substantially virgin lead slugs of similar solid longitudinally cylindrical shape closely fitting within the casing, and each having flat planar surfaces at the opposing transverse ends of the cylindrical slug, the outermost slug extending beyond the open end of the casing to which it is crimped to expose its flat planar outer surface, the slugs each being of weight in the range of from about 56.5 grains to about 125 grains, and the powder charge being adjusted to achieve a slug velocity of about 700 to 900 feet per second in order to provide non-lethal stopping power.

2. A round as claimed in claim 1 and in which at least a portion of the outermost slug is provided with copper cladding.

3. A round as claimed in claim 2 and in which the terminal region of the exposed outermost slug is of diameter reduced from that of the portion of the slug within the casing.

4. A round as claimed in claim 3 and in which the reduced diameter terminal region is cylindrical.

5. A round as claimed in claim 3 and in which the reduced diameter terminal region is frusto-conical.

6. A round as claimed in claim 3 of 0.45 ACP caliber packed with two similar abutting slugs each weighing about 125 grains and with powder charge sufficient to expel the slugs at about 800 f.p.s..

7. A round as claimed in claim 3 of 0.357 caliber packed with four similar successively abutting slugs each weighing about 56.5 grains and with powder charge sufficient to expel the slugs at about 900 f.p.s..

8. A round as claimed in claim 3 of 0.38 special caliber packed with three similar successively abutting slugs of about 56.5 grams and with powder charge sufficient to expel the slugs at about 800 f.p.s..

9. A round as claimed in claim 3 of 9 mm caliber packed with two similar abutting slugs of weight about 56.5 grams and with a powder charge sufficient to expel the slugs at about 700 f.p.s..

10. A round as claimed in claim 1 and in which the powder is a fast burning nitroglycerin/nitrocellulose mixture producing a flame temperature of about 3524° k, about 1420 calories/gram of explosion heat, and about 0.0387 moles of gas/gram.

* * * * *